United States Patent [19]

LaRue

[11] 4,427,198

[45] Jan. 24, 1984

[54] BINGO GAME WITH SPECIAL MARKER

[76] Inventor: Kenneth LaRue, 33508 Edmonton, Farmington Hills, Mich. 48204

[21] Appl. No.: 278,756

[22] Filed: Jun. 29, 1981

[51] Int. Cl.[3] ..... A63F 3/06

[52] U.S. Cl. ..... 273/269; 273/288

[58] Field of Search ..... 273/269, 270, 272, 288

[56] References Cited

U.S. PATENT DOCUMENTS 2,847,222 8/1958 Weeks ..... 273/273

3,413,004 11/1968 Smith ..... 273/269

FOREIGN PATENT DOCUMENTS 1002547 3/1952 France ..... 273/269

4612 of 1911 United Kingdom ..... 273/269

*Primary Examiner*—Richard C. Pinkham

*Assistant Examiner*—Scott L. Brown

*Attorney, Agent, or Firm*—Charles W. Chandler

[57] ABSTRACT

A marker for use in playing bingo formed of a transparent plastic having translucent sides and a thickness of about one quarter of an inch such that when the user views the marker at an oblique angle with respect to the bingo card, a number on which the marker is disposed has an image offset with respect to the other uncovered numbers.

4 Claims, 4 Drawing Figures

BINGO GAME WITH SPECIAL MARKER

BACKGROUND OF THE INVENTION

This invention is related to a game in which randomly selected numbers are covered by markers, and more particularly to such a game having a second set of markers for covering certain non-selected numbers, the second set of markers each having a thickness sufficient to offset the image of the number on which the marker is placed so that the number visually stands out from the other non-selected numbers.

Numerous games, such as Bingo, employ a flat board on which a series of numbers are displayed, the numbers being progressively covered by Bingo markers as the numbers are called at random. Many Bingo players employ several cards simultaneously during the course of play. As the numbers on a particular card are covered to progressively form either a diagonal, vertical or horizontal row or to cover the center and four corner numbers, certain non-selected numbers are of interest. It is desirable after each number is called to be able to glance at several cards and quickly and visually spot those numbers necessary to complete a winning combination. This is difficult when several cards are being used.

SUMMARY OF THE INVENTION

The broad purpose of the present invention is to provide a marker for games, such as Bingo, comprising an element formed of a transparent plastic having a thickness of about one quarter of an inch such that when placed on a non-selected number, the image of the number viewed through the marker is substantially offset from the other numbers when viewed at an oblique line of sight with respect to the Bingo card, thus aiding the user in quickly locating and matching a called number with a number covered by the special marker.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
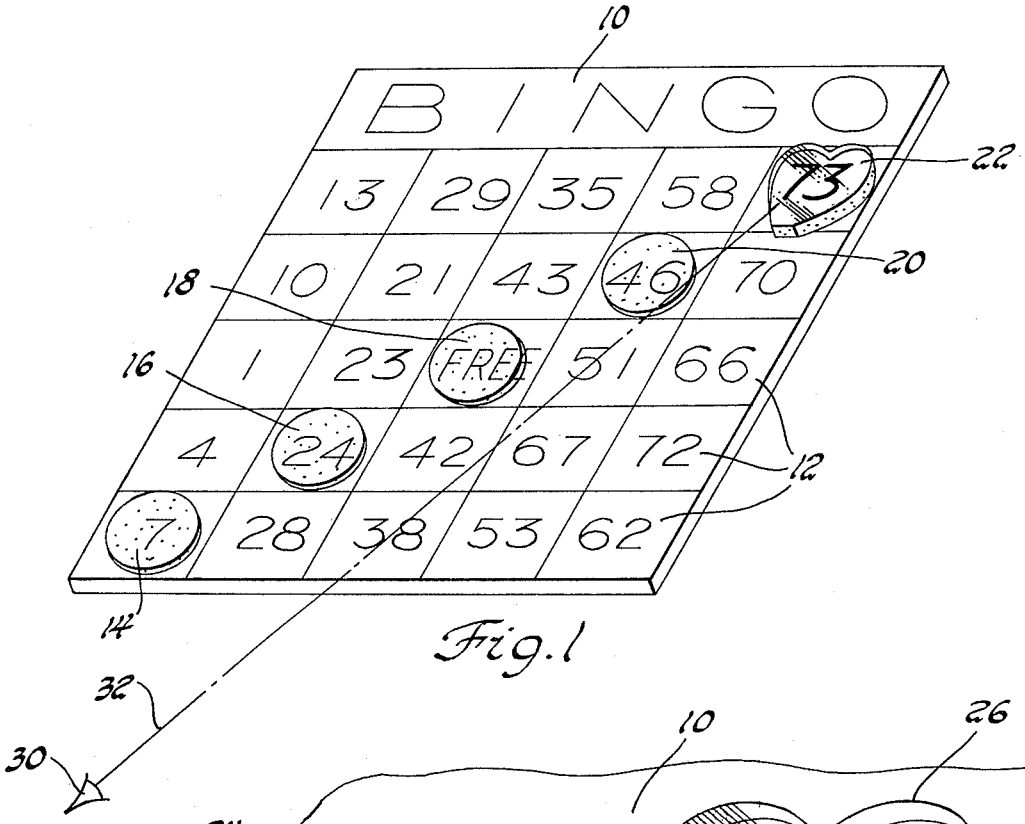
FIG. 1 illustrates a conventional Bingo card having a series of selected numbers covered by conventional markers and a non-selected number covered by a marker made in accordance with the invention.

Referring to the drawing, FIG. 1 illustrates a conventional Bingo card 10 having twenty-five numbers 12 arranged in five columns, five numbers in each column. As is well known to those skilled in the art, the numbers are arranged in a random fashion. In accordance with the rules of the game, numbers are randomly selected and covered when they match up to identical numbers on the card.

Four conventional markers 14, 16, 18, and 20 partially form a diagonal row from the lower left hand corner to the upper right hand corner. These markers are conventionally thin and are formed of a partially transparent plastic material with wires embedded in the marker suitable for a magnetic pickup device, not illustrated.

Figure 2:
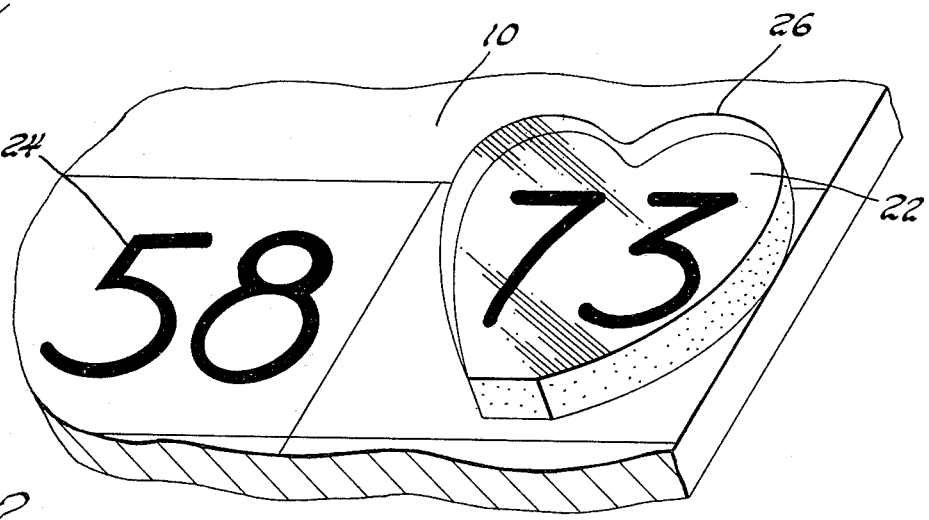
FIG. 2 is an enlarged fragmentary view of a portion of FIG. 1.
Figure 3:
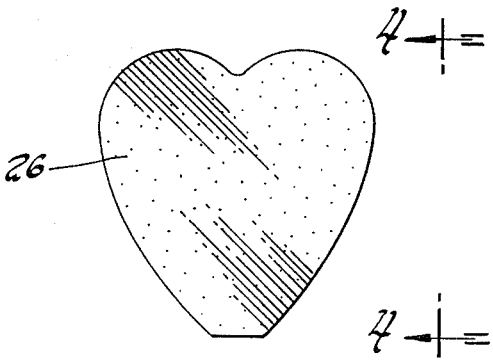
FIG. 3 is a plan view of the preferred marker.

FIG. 2 is an enlarged view of the upper right hand corner of card 10. The number "22" in the upper right hand corner is of the same size and along the same horizontal row as the adjacent number "24".

A marker 26 is disposed on the same square containing number 22. Marker 26, preferably has a diameter slightly less than the diameter of the square containing number 22, which for purposes of illustration, is about $\frac{7}{8}$ of an inch square.

Figure 4:
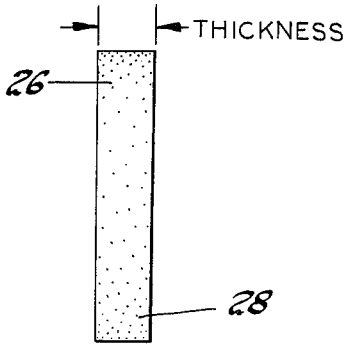
FIG. 4 is a side view of the preferred marker.

Bingo marker 26 is formed of a transparent plastic such as acrylic, and has a thickness of about one quarter of an inch, the thickness being measured as illustrated in FIG. 4. The peripheral surface 28 of the marker is preferably tinted with an appropriate coloring medium so as to form an opaque surface. The upper and lower surfaces of the marker are transparent so that the number on which the marker is placed has an image that can be viewed through the top of the marker. The thickness is such that the number can be viewed when user 30 is viewing the number at an oblique angle along a line-of-sight 32 with respect to the board, as illustrated in FIG. 1. The marker offsets the image of the number on which it is disposed with respect to the other numbers on the same row so that the covered unselected number stands out with respect to the other unselected numbers.

In use, conventional bingo markers are placed on the bingo card in the conventional way, that is, when the caller calls out a number that corresponds to one of the numbers on the bingo card, the user places one of the thin markers on that number. As further matching numbers are called, he places other thin markers on the designated numbers until there is only one open space remaining to form a winning combination. Obviously, if other potential combinations have been lined up on a given card, the thick bingo markers are used to highlight the location of those numbers required to complete a winning combination.

It is apparent that the marker can take other forms and has peripheral configurations other than the heart-shaped appearance of marker 26 and that the thickness can vary as long as it has a relatively substantial thickness of about one quarter of an inch.

Having described my invention, I claim:

1. In combination:

a Bingo card having an array of numbers arranged in five rows, each row having five numbers;

at least three relatively thin bingo markers removably disposed on at least three selected numbers on the card for covering such numbers, said first bingo markers having a first thickness;

a fourth Bingo marker formed of a transparent material and having a second thickness substantially greater than said fourth thickness, and disposed on the Bingo card on a fifth number which when combined with said selected numbers forms a winning Bingo combination, said fourth marker presenting an image offset from the position of the fourth number on the card when placed upon such number and the user is viewing the fourth number at an oblique angle with respect to the Bingo card.

2. A combination as defined in claim 1, in which the thickness of the fourth Bingo marker is about one quarter of an inch, and includes an upper surface, a lower surface, and a peripheral surface bounding the upper and lower surfaces, and color means disposed on said peripheral surface.

3. A combination as defined in claim 1, in which the fourth marker is formed of an acrylic plastic.

4. A combination as defined in claim 1, in which the fourth marker has a heart-shaped peripheral surface.

* * * * *

UNITED STATES PATENT AND TRADEMARK OFFICE

CERTIFICATE OF CORRECTION

PATENT NO. : 4,427,198

DATED : January 24, 1984

INVENTOR(S) : Kenneth LaRue

It is certified that error appears in the above-identified patent and that said Letters Patent is hereby corrected as shown below:

In Claim 1, column 2, line 58 of the Patent, delete the word "fourth" and insert thereinstead --- first ---.

In Claim 1, column 2, line 59, of the Patent, delete the word "fifth" and insert thereinstead --- fourth ---.

Signed and Sealed this

Twentieth Day of October, 1992

*Attest:*

DOUGLAS B. COMER

*Attesting Officer*

*Acting Commissioner of Patents and Trademarks*